US005390580A

United States Patent [19]

Gibbons, Jr. et al.

[11] Patent Number: 5,390,580

[45] Date of Patent: Feb. 21, 1995

[54] LIGHTWEIGHT EXPLOSIVE AND FIRE RESISTANT CONTAINER

[75] Inventors: Gould Gibbons, Jr., Finksburg; Anthony E. Finnerty, Forest Hill, both of Md.

[73] Assignee: The United States of America as represented by the Secretary of the Army, Washington, D.C.

[21] Appl. No.: 98,915

[22] Filed: Jul. 29, 1993

[51] Int. Cl.[6] ..... F42B 39/14

[52] U.S. Cl. ..... 86/50; 89/34; 109/49.5; 169/58; 206/3; 220/428; 220/429; 244/129.2

[58] Field of Search ..... 86/50; 206/3, 524.2; 244/129.2; 220/88.1, 415, 426, 428, 429; 169/43, 46, 47, 26, 58, 62; 109/49.5; 89/34

[56] References Cited

U.S. PATENT DOCUMENTS

| | | | |
|---|---|---|---|
| 2,407,500 | 9/1946 | Krasner et al. | 206/3 |
| 2,420,663 | 5/1947 | Heath et al. | 206/3 |
| 3,800,715 | 4/1974 | Boller | 86/50 |
| 4,055,247 | 10/1977 | Benedick et al. | 206/3 |
| 4,121,666 | 10/1978 | Rozniecki | 169/62 |
| 4,132,271 | 1/1979 | Mikaila | 169/62 |
| 4,286,708 | 9/1981 | Porzel | 206/3 |
| 4,389,947 | 6/1983 | King et al. | 86/50 |
| 4,727,789 | 3/1988 | Katsanis et al. | 86/50 |
| 4,878,415 | 11/1989 | Foster, Jr. et al. | 206/3 |
| 5,022,307 | 6/1991 | Gibbons, Jr. et al. | 89/34 |

FOREIGN PATENT DOCUMENTS

| | | | |
|---|---|---|---|
| 2809708 | 9/1979 | Germany | 206/3 |

*Primary Examiner*—Harold J. Tudor
*Attorney, Agent, or Firm*—Freda L. Krosnick; Muzio B. Roberto

[57] ABSTRACT

An explosive and lightweight container comprising fire-extinguishing and energy absorbing components. The fire-extinguishing component include an exterior vented plate; a honeycomb element filled with a fire-extinguishing agent; and separated from the vented plate by a membrane to prevent leakage and contamination. The energy absorbing component includes an energy absorbing material; pusher plate; and a honeycomb crush element. In operation, any blast and conflagration are mitigated by energy absorbing material and fire-extinguishing material, respectively.

4 Claims, 1 Drawing Sheet

LIGHTWEIGHT EXPLOSIVE AND FIRE RESISTANT CONTAINER

RIGHTS OF GOVERNMENT

The invention described herein may be manufactured, used, licensed by or for the Government for Governmental purposes without the payment to us of any royalties thereon.

BACKGROUND OF THE INVENTION

1. Field of Invention

This invention relates to a light weight explosive and fire resistant container having utility in the transporting or storage of munitions. The container comprises a combination of materials and structures arranged so that on the accidential detonation of an explosive, the blast is mitigated, and the risk of fire is reduced so as to minimize damage to the carrier and injury to personnel.

2. Brief Description of the prior Art

Much work has been done to control, or mitigate the effects of an explosive against an adjacent structure. A well known example of such work is the ammunition compartment of the M1 and MIA1 Abrams Tank. Given an explosion, the ammunition compartment controls the effect by venting gases, pressures, and fragments to the outside of the vehicle. Crew and vehicle are protected, and survivability is enhanced. However a combat vehicle is very heavy, e.g., the M1 weighs about 60 tons. Therefore, the technology which is applicable to a military vehicle, would not be applicable to an aircraft.

Other examples of the prior art are a line of products manufactured by Shielding Technologies, Inc. (STI) of Bel Air, Md. An example is U.S. Pat. No. 4,727,789.

The shields are constructed of steel grating, steel perforated plates, steel louvered panels or wire screening used singly or together as a composite. The panels form a labyrinth through which the explosive gas must pass to get to the other side of the device. The pressure of these gases is reduced by traveling through the tortuous path of the labyrinth. The devices are very strong and designed to withstand and bullet impact without being destroyed. Also, the mass of the device is large enough to reduce thermal hazard from fire, but not enough to extinguish a fire. The weight of the steel and copper in these containers renders them impractical for carrying passenger baggage and packages commonly transported on aircraft.

The present invention utilizes light materials, i.e., sheet metals of steel, aluminum, and modern composites to create a light weight structure. The wall construction of the present invention has an area density of approximately 10/pounds/square foot, whereas the area density of the STI structure, sufficient to suppress a 2 pound TNT event , has an area density of approximately 21 pounds/square foot. A container with 180 square feet of surface area would weigh 1800 pounds using the present technology, compared to about 3,780 pounds using the prior art technology.

SUMMARY OF INVENTION

Military aircraft may be used to transport ammunition, such as high value missiles. While accidential detonation of a munition is unlikely, it would be desirable to have the munition shipped in an arrangement that would mitigate blast and reduce the risk of fire so as to prevent or mitigate loss of any personnel or aircraft, given a detonation of the munitions.

The invention provides a practical container in which materials having a potential for explosion can be shipped in an aircraft with reduced risk. The invention can be applied to both commercial and private carriers to provide increased aircraft protection for cases of authorized, or unauthorized inclusion of explosions in aircraft baggage or cargo, when compared to existing containers.

The present invention provides a means of reducing blast and fire damage to an aircraft if an explosive device present in the cargo or bay area explodes. This is accomplished by a multipanel system comprising energy absorbing and fire-extinguishing components incorporated into the system. The system is integral with the walls of the container.

It is an object of the present invention to provide and disclose a lightweight explosive and fire-resistant container suitable for transporting explosive materials in aircraft, comprising an energy absorbing and fire resistant component.

It is a further object of the invention to provide and disclose a lightweight and fire-resistant container to mitigate an explosive blast in the interior of the safety container.

It is a further object of the invention to provide and disclose a lightweight and fire-resistant container to mitigate an explosive blast and fire on the exterior of the container.

Other objects and a fuller understanding of the invention may be ascertained from the drawings, specification and claims.

DRAWINGS

DESCRIPTION OF PREFERRED EMBODIMENT

Figure 1:
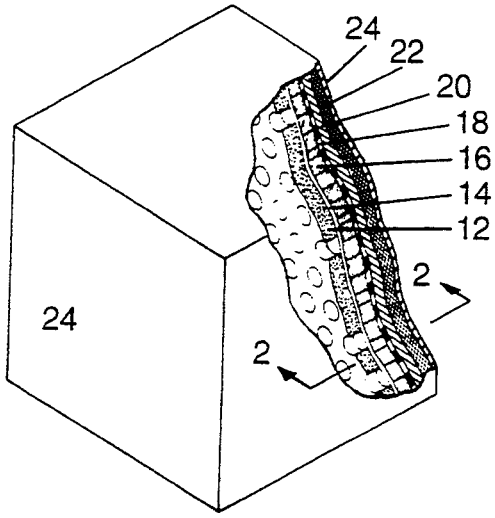
FIG. 1 is a prospective view of a system of the invention showing a section of the interior wall construction thereof.
Figure 2:
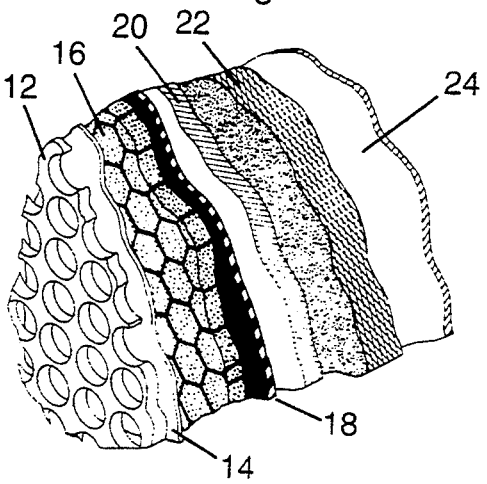
FIG. 2 is a cross-sectional view of the fire-extinguishing and energy-absorbing components of a representative side-wall of the container through 2—2 of FIG. 1.
Figure 3:
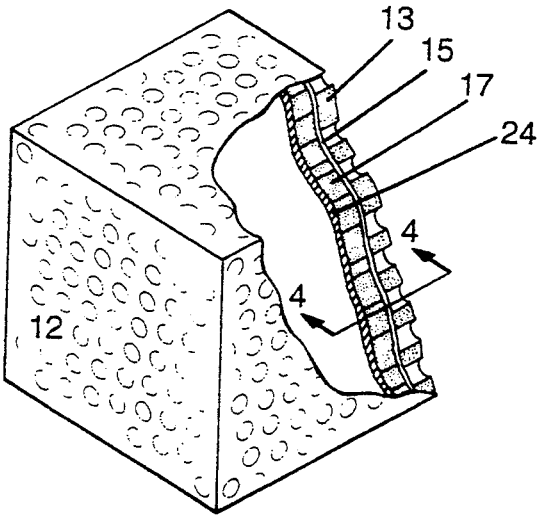
FIG. 3 is a prospective, exterior view of the fire-extinguishing components of a lightweight container of the present invention.
Figure 4:
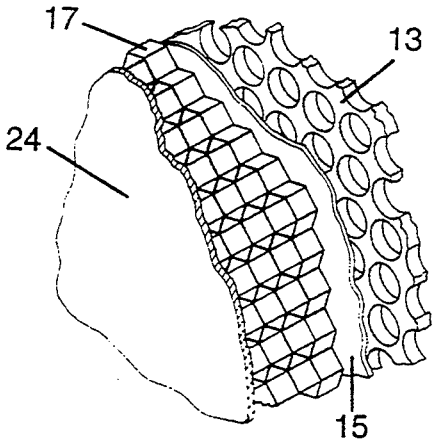
FIG. 4 is a cross-sectional view through 4—4 of FIG. 3 above of fire-extinguishing components of a representative side-wall positioned in the exterior of a cargo container.

Referring now to FIG. 2 of the drawing, there is shown a cross-sectional view of a representative wall of the container through 2—2, of FIG. 1 encompassing the cargo area. The structure encompasses fire-extinguishing and energy-absorbing components. Starting from the interior to the exterior of the container toward the exterior thereof, the fire-extinguishing components comprise vented plate 12, membrane 14 and honeycomb element 16. The function of the honeycomb element is to seal the fire-fire-extinguishing agent preventing loss or contamination of the agent.

Vented plate 12 may be constructed of aluminum or stainless steel. The plate has the configuration of a pegboard and may contain apertures of various sizes and configurations. The honeycomb element is constructed of aluminum and filled with any conventional fire-extinguishing material, such as for example, a mixture of water, antifreeze and a thickening agent. In the alternative, a powder may be used such as, e.g., alumina or potassium bicarbonate.

If an explosion occurs in the container, the vented plate is forced against the agent filled honeycomb, thereby releasing fire-extinguishing material as the honeycomb compresses, the invention ensures a supply of the extinguishing material at the site of the explosive event, and in the cargo area of the aircraft, where a shipping container ruptures due to extremely high pressure from the event. Burning debris, ejected from such an explosion, would cause a fire in the cargo section of an aircraft, if the fire-extinguishing agent is not present.

The energy absorbing function is performed by energy absorbing rubber element 18, pusher plate 20, honeycomb crush element 22, in combination with structural wall 24 of the safety container. The presence of the energy absorbing rubber on the surface of pusher plate 20 reduces shock loading and prevents shattering of the plate. If an explosion occurs within the container, the pusher plate compresses the honeycomb element over a large footprint, thereby mitigating the explosive shock, and increasing the rise time of the pressure wave. This process insures a more uniform pressure loading to the surrounding environment which is preferable to high localized shock pressure that would occur if the container ruptured into many small pieces.

Examples of materials operable as energy absorbing elements in the present invention include energy absorbing rubber 18; ⅛" Isodamp C1002, sold by E. A. R. Division of Cabot Corporation, Indianapolis, Ind.; pusher plate 20; 1/16" aluminum or mild steel; crush or honeycomb material, or aluminum honeycomb 22: ⅝" Nomex/Kevlar material sold by Advanced Technology & Research,Inc., or aluminum honeycomb.

The second fire-extinguishing component is positioned on outside wall 24 of the explosive and fire-resistant container. The elements are the same as those positioned on the inside of the cargo area, i.e., 1% honeycomb element 17 filed with fire-extinguishing material positioned adjacent to outside wall 24, followed by sealing membrane 15 and 13 vented face plate 13.

The interior components of this invention mitigates a conflagration or explosive blast inside the cargo container, whereas, the exterior components mitigate a conflagration or explosive blast on the outside of the cargo area.

Although we have described our invention with a certain degree of particularity, it is understood that various modifications can be made in the arrangement of structures and components without departing from the invention as herein claimed.

Having described our invention, we claim:

1. A lightweight container system having an interior defining a cargo area for storing and transporting explosives, comprising successively, inner vented plate means adjacent the cargo area, a membrane adjacent said inner vented plate means, interior fire-extinguishing means for mitigating any conflagration positioned adjacent the membrane, energy absorbing means positioned adjacent the interior fire-extinguishing means to mitigate the effect of any explosion, structural container wall positioned adjacent said energy absorbing means and exterior fire-extinguishing means positioned adjacent structural container wall to mitigate any blast effect on the exterior of the lightweight container system.

2. A system in accordance with claim 1, whereas the exterior fire-extinguishing means comprises, respectively:

a vented exterior plate, a membrane positioned adjacent the vented exterior plate, a honeycombed element filled with a fire extinguishing material positioned adjacent to the membrane.

3. A system in accordance with claim 1 wherein the energy absorbing means in the interior of the system comprises, respectively;

an energy absorbing material, a-pusher plate, and a honeycombed crush element positioned adjacent the structural container, so that on the initiation of a explosive event in the interior of the container system the blast and any resultant conflagration are mitigated.

4. A lightweight container system having a interior and exterior for containment of explosive, suitable designed to reduce both explosive blast effects contained in a cargo area, and the potential for fire by passive means having the following components positioned respectively:

inner vented plate means adjacent the cargo area, a membrane positioned adjacent the vented plate means and a honeycombed element filled with a fire-extinguishing agent so as to mitigate any conflagration in the interior of the container, an energy absorbing element, pusher plate means, a honeycombed crush element positioned adjacent the pusher plate means, a structural container wall adjacent the honeycombed crush element, an outer honeycombed element on the exterior of the structural container wall filled with fire-extinguishing material so as to mitigate any conflagration on the exterior of the container system, membrane means positioned adjacent outer honeycombed element, and outer vented plate means.

* * * * *